United States Patent [19]

Bergeron

[11] Patent Number: 4,862,727

[45] Date of Patent: Sep. 5, 1989

[54] HOISTING STRUCTURE FOR AUTOMOTIVE VEHICLE

[76] Inventor: Marcel J. Bergeron, 214, Rg St-Edouard, Iberville, Quebec, Canada, J2X 4J3

[21] Appl. No.: 205,830

[22] Filed: Jun. 13, 1988

[30] Foreign Application Priority Data

Aug. 24, 1987 [GB] United Kingdom ..... 8719910

[51] Int. Cl.[4] ..... B21D 1/12

[52] U.S. Cl. ..... 72/457; 72/705; 187/8.56; 254/94

[58] Field of Search ..... 72/457, 705; 254/45, 254/49, 50, 94; 187/8.56, 8.71

[56] References Cited

U.S. PATENT DOCUMENTS 1,381,592 6/1921 Price ..... 187/8.56
3,276,237 10/1966 Transue ..... 72/705
4,463,937 8/1984 Celette ..... 72/705
4,574,614 3/1986 Field ..... 72/705

*Primary Examiner*—Lowell A. Larson
*Attorney, Agent, or Firm*—Roland L. Morneau

[57] ABSTRACT

A vehicle hoist having four separate pivoting shafts. Each shaft is pivotally and slidingly mounted at its lower end on a transversal cylindrical beam which is fixed on a frame. The shaft is adapted to move between a horizontal and a vertical position. The frame is fixed on a base structure and adapted to longitudinally slide on it. The top of each shaft is pivotally connected to an anchoring member which is adapted to grip the rocker panel pinchwelds of the vehicle. When the vehicle is pulled horizontally, the four shafts gripping the vehicle, raise the latter. Abutting components stop and hold the shafts in their upright position. The transversal and longitudinal movements are provided to adjust to the width and the length of the different types of vehicles.

10 Claims, 3 Drawing Sheets

HOISTING STRUCTURE FOR AUTOMOTIVE VEHICLE

BACKGROUND OF THE INVENTION

1. Field of the Invention

This invention is related to an elevating structure and more specifically to a pivoting elevating structure adapted to grip and to lift automotive vehicles and which allows such operations as straightening of the vehicle frame.

2. Prior Art

Numerous patents related to the vehicle repair art disclose devices comprising one or more hydraulically operated posts which are provided on their upper ends with arms which move through horizontal planes to engage with the frame of the vehicle to be raised.

However, this type of hoisting device is considered quite expensive in regards to its installation cost and relatively unefficient because of the limited access to the underside of the vehicle and the restrictive number of tasks they can performed. Indeed, operations like the straightening of a vehicle frame cannot always be adequately performed on such known type of hoisting device.

Since there exists a large number of so called "body shops" specializing in the repair of collision damaged vehicles, there is a need for quickly raising an hoisting device which can be used for a variety of tasks including the straightening of frames.

Patent such as U.S. Pat. Nos. 1,942,945 and 4,447,042 discloses vehicle lifts using X-shaped structures with pistons for hoisting cars. The U.S. Pat. No. 4,277,049 is directed to a lift structure for servicing vehicles. All four elevating members are synchronized by a pair of supporting members.

None of the hoisting devices comprises shaft means to individually lift the vehicle and also to be attached to the rocker panel pinchwelds of the vehicle while allowing pulling on the vehicle frame by suitable means such as conventionally known winches.

Known hoisting devices, only partially fullfill some of the above mentioned needs. These devices are generally not easy to manipulate, are mechanically complicated and therefore relatively expensive.

SUMMARY OF THE INVENTION

The invention relates to a substantially simplified structure particularly adapted for use in connection with the straightening of collision damaged vehicles.

The vehicle hoisting mechanism requires no hydraulic or pneumatic piston components to lift the vehicle, therefore rendering the system safer to the operator.

The vehicle hoisting device according to the invention which is fast and easy to operate since it is provided with efficient fastening means.

It is further an object of the invention to provide a vehicle hoisting device which does not require much storing space and which can be adapted to conventional car platforms.

The vehicle hoisting device according to the invention is readily adapted to vehicles of different widths and lengths.

The hoisting structure comprises a set of pivoting shafts allowing the vehicle body to be lifted upon horizontal traction on the body by a simple pulling device such as a small winch. The shaft is pivotally mounted at both ends to move between a substantially horizontal and a substantially vertical position. The upper end of the shaft is adapted to grip the rocker panel pinchwelds of a vehicle through pivoted anchor means which can be secured in a fixed position. The lower end of the shaft pivots about a horizontal axis. An abutment stops the shaft in its upright position.

DETAILED DESCRIPTION OF THE PREFERRED EMBODIMENT

Figure 1:
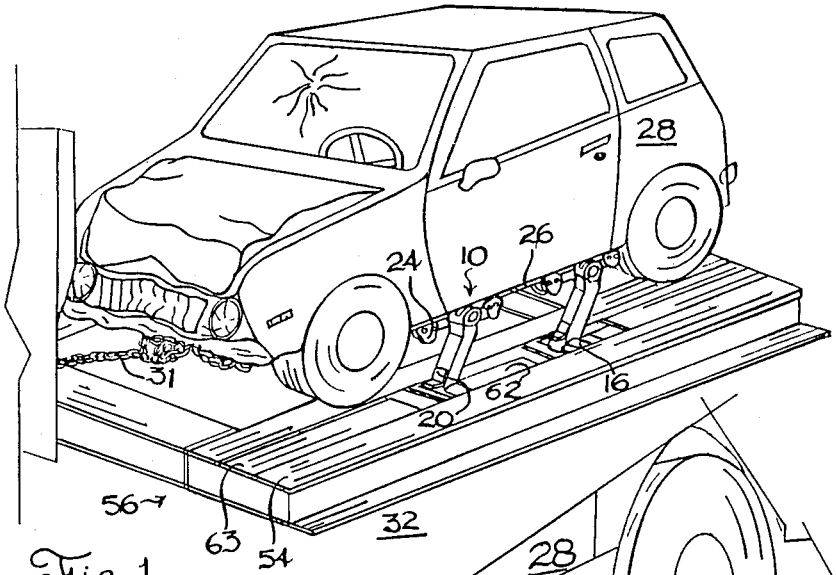
FIG. 1 is a schematic perspective view of a vehicle pulled by a chain into the lifted position by the hoisting structure according to the invention.
Figure 2:
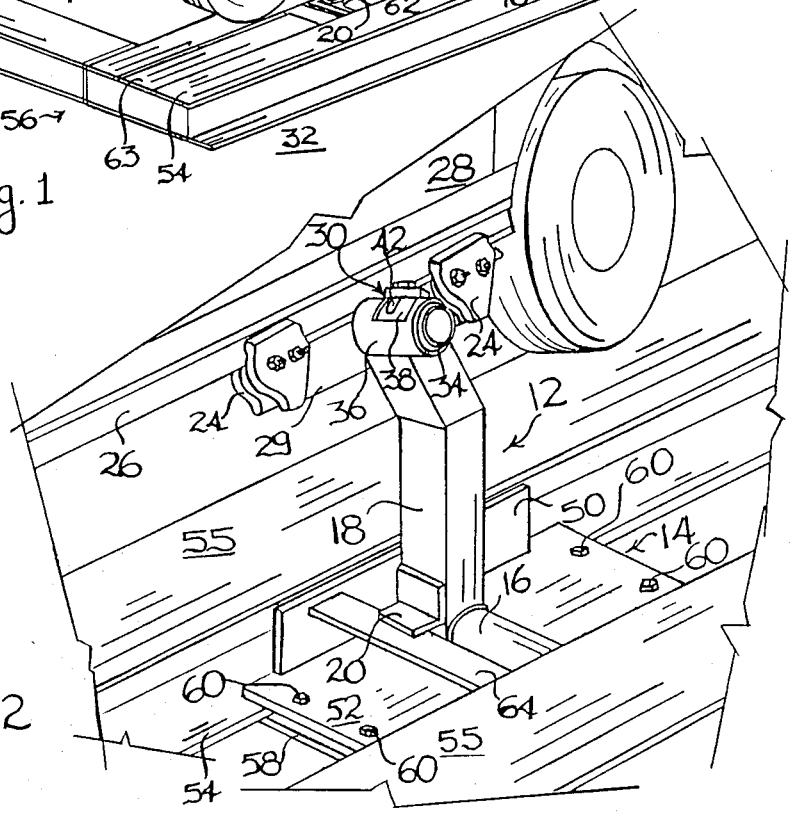
FIG. 2 is a schematic perspective view of one of the pivoting shafts of the hoisting structure in its raised position mounted in a recessed pathway into which the structure is positioned.

Referring to the drawings, the hoisting device is generally indicated by the reference numeral 10. Said structure 10 comprises a set of four separate pivoting structures 12. Each pivoting structure 12 comprises a frame 14 in which is fixed an horizontal cylindrical beam 16. A shaft or leg member 18 is pivotally mounted at one of its end on said cylindrical beam 16. Said shaft 18 can pivot from a substantially horizontal to a substantially vertical position and back. Abutting means in the form of an L-shaped component 20 secured to the shaft 18 is used to stop the shaft 18 in its upright position.

Figure 3:
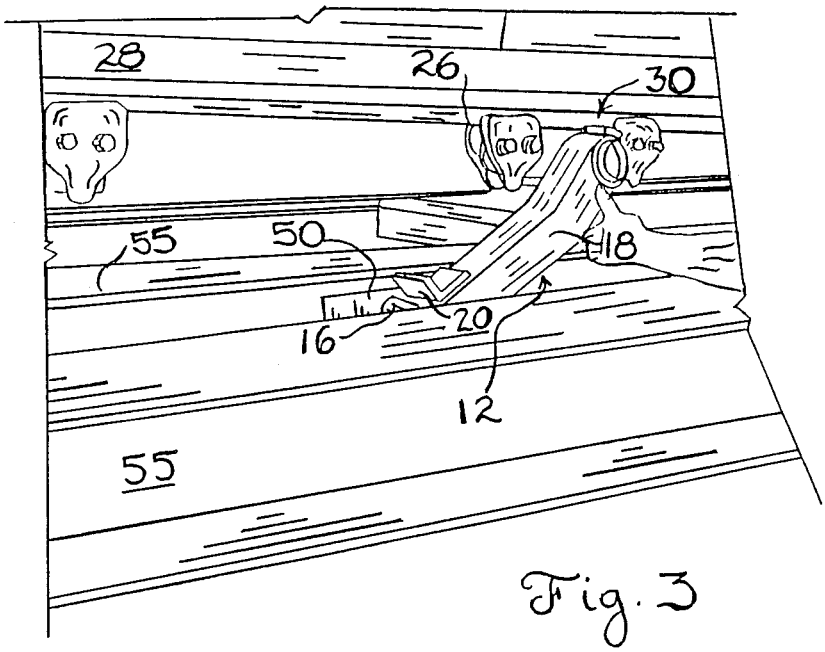
FIG. 3 is a schematic perspective view of one of the pivoting shafts of the structure being attached to the rocker panel pinchwelds of a vehicle.
Figure 5:
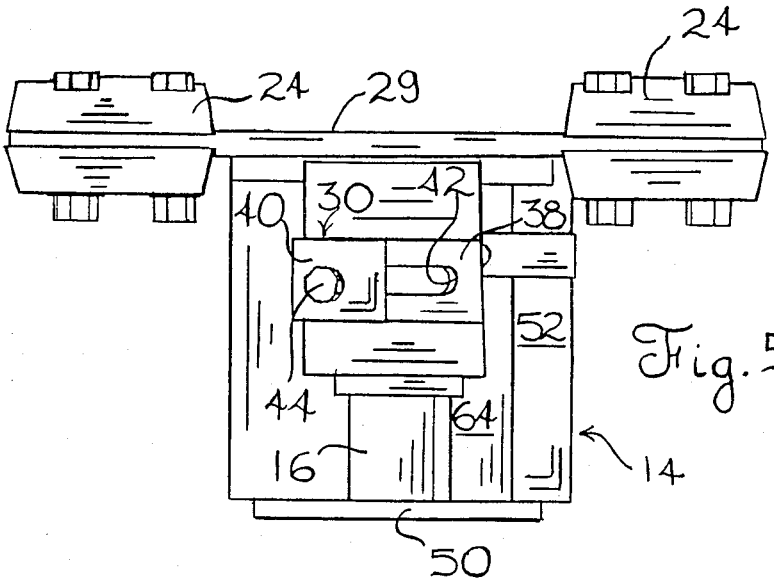
FIG. 5 is a schematic top plan view of one of the pivoting structures in an upright position.
Figure 6:
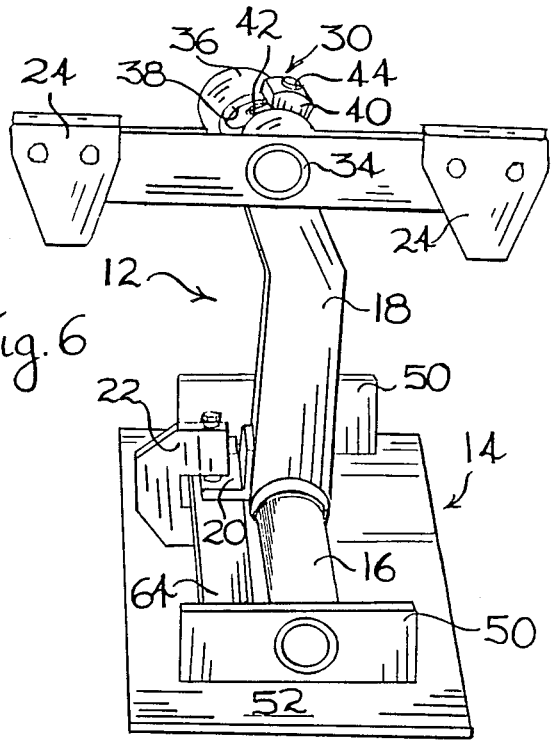
FIG. 6 is a schematic side perspective view of one of the pivoting structures in its upright position.
Figure 7:
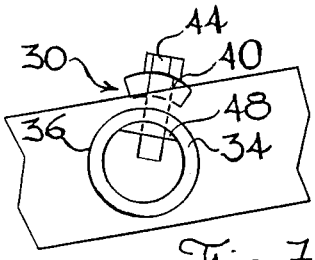
FIG. 7 is a schematic detailed view of the tightening means used to secure the anchor means in a fixed position relative to the pivoting shaft.
Figure 4:
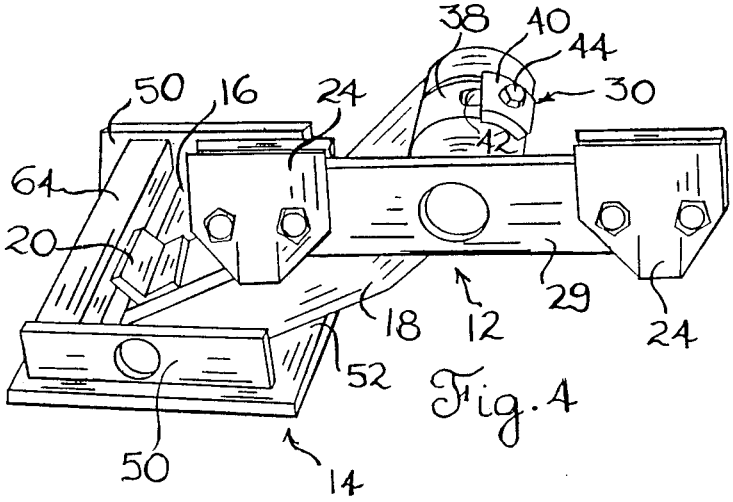
FIG. 4 is a schematic top perspective view of one of the pivoting structures in an intermediate position.

A hand clamp 22 (FIG. 6) or other suitable means is provided to hold the component 20 and to maintain shaft 18 in the vertical position. Anchoring means such as conventionally known anchor clamps 24 are pivotally mounted at the other end of shaft 18 and are used to grip the rocker panel pinchwelds 26 of the vehicle 28 and hold the shaft 18 in its upright position. Tightening means such as nut and bolt arrangement 30 is used to secure a plate 29 connecting the anchor clamps 24 in a fixed position relative to shaft 18. Each of the pivoting structure 12 is adapted to be clamped to the vehicle body when it is upwardly tilted manually as shown in FIG. 3. When the body of the vehicle 28 is pulled along an horizontal direction, such as by the chain 31, the shaft 18 freely pivots around beam 16 to a vertical portion and anchor clamps 24 pull the vehicle in its raised position. When seen from the side of the vehicle or as illustrated in FIG. 1, the combination formed by the undercarriage or rocker panel 26 of the vehicle 28, the ground 32 and two pivoting structures 12 represents a parallelogram which is modified as the vehicle is being pulled with the undercarriage of the vehicle 28 remaining parallel to the ground 32 at all times.

In the preferred embodiment, the plate 29 connecting the anchor clamps 24 is pivotally mounted on shaft 18 by means of a sleeve system comprising an inner cylindrical sleeve 34 rotatably inserted in an outer cylindrical sleeve 36. A larger groove 38 is provided in the outer sleeve 36 to allow sliding of a washer type element 40 while a narrow groove 42 in the inner sleeve 34 is provided to allow pivoting of fastening bolt 44. When the inner sleeve 34 is properly positioned relatively to the outer sleeve 36, bolt 44 extends through both sleeves 34 and 36 and is tightened with a nut 48 so that both sleeves are held together to prevent their relative rotation. Frame 14 comprises two side panels 50 which support the horizontal cylindrical beam 16. Panels 50 are rigidly linked by welding or by other suitable manner to a fixation plate 52. The top fixation plate 52 rests on the inner flanges 54 of two lateral "I-beams" 55 forming the structure of pathway 56.

A bottom fixation plate 58 is used in conjonction with fastening means such as bolts 60 to clamp flanges 54 and to longitudinally fix frame 14 in the pathway 56. When not in use, pivoting structure 12 can be concealed inside a recess 62 located between the two "I-beams" 55 and below cover plate 63. The fixation plates 52 and 58 allow longitudinal adjustment of the hoisting device depending on the length of the undercarriage of the vehicle 28 by sliding the pivoting structures 12 on the flanges 54 which constitute a runway for the fixation plates 52 and 58.

Adjustments in regards to the width of the vehicle are made possible by sliding of shaft 18 on the cylindrical beam 16. A plate 64 is rigidly connected to side panels 50 in a parallel fashion with cylindrical beam 16. A plate 64 secured across the plates 50 is used in conjunction with "L-shaped" component 20, as abutting means, and component 20, in conjunction with the hand-clamp 22 as fastening means to hold and maintain shaft 18 in an upright position.

The shaft 18 is preferably bent in the direction of the L-shaped component 20 so that the vehicle has a tendency to maintain the abutment between the component 20 and the plate 64, which increases the stability of the vehicle in its raised position.

I claim:

1. A set of four separate pivoting structures mounted on a base structure for allowing a vehicle body to be lifted upon horizontal traction on said body, each pivoting structure comprising:

a frame slidingly adjustable on said base structure, a cylindrical beam horizontally fixed across said frame, a shaft pivotally mounted at one end on said beam between a substantially horizontal and a substantially vertical position, abutting means for stopping said shaft against said frame in the vertical position and locking means for maintaining said shaft in its vertical position, anchor means pivotally mounted at the other end of said shaft for clamping said body, tightening means for securing the anchor means in a fixed position relative to said shaft, wherein said pivoting structure is adapted to be clamped to said vehicle body when the shaft is in a tilted position located between the horizontal and the vertical position, the car body being lifted when the latter is pulled horizontally in the direction of said abutting means.

2. A set of four separate pivoting structures as recited in claim 1, wherein said shaft is slidingly mounted on said cylindrical beam for laterally moving said anchor means according to the width of the vehicle body.

3. A set of four separate pivoting structures as recited in claim 1, wherein said abutting means comprise an angle bracket secured to said shaft adjacent said cylindrical beam.

4. A set of four separate pivoting structures as recited in claim 3, wherein said locking means comprise a gripping device for holding said angle bracket against said frame.

5. A set of four pivoting structure as recited in claim 3, wherein said shaft is bent in the direction of said bracket, said tightening means being located over said bracket for stabilizing the vehicle when the shaft is in upright position.

6. A set of four separate pivoting structures as recited in claim 1, wherein the said other end of the shaft comprises a first cylindrical sleeve rotatably mounted in a second cylindrical sleeve, the said second sleeve supporting said anchor means, the said sleeves being provided with a slot therethrough, threaded means extending through said slot for tightening both sleeves together to prevent their relative rotation.

7. A set of four pivoting structure as recited in claim 1, wherein said frame comprises adjustable clamping means for longitudinally adjusting said frame on said base structure.

8. A set of four pivoting structures as recited in claim 1, said base structure comprising a platform, two recessed pathways, each pathway adapted to receive a pair of said pivoting structures, one end of the shaft of each of said pairs of said pivoting structures adapted to raise above said platform, a chain pulling mechanism adapted to pull on a car body, whereby when said vehicle body is anchored on said pivoting structures, said mechanism is adapted to lift said vehicle body.

9. A set of four pivoting structure as recited in claim 8, wherein said pathways comprises lateral beams for supporting said frame, said frame having a pair of superposed plates and means for tightening said plates on said beams.

10. A set of four pivoting structure as recited in claim 1, wherein said abutting means comprises an L-shaped component secured to said shaft and adapted to abut on said frame.

* * * * *